US005420097A

United States Patent [19]

Vanmaele et al.

[11] Patent Number: 5,420,097

[45] Date of Patent: May 30, 1995

[54] DYE-DONOR ELEMENT COMPRISING MAGENTA-COLOURED TRICYANOVINYLANILINE DYES

[75] Inventors: Luc Vanmaele, Lochristi; Wilhelmus Janssens, Aarschot, both of Belgium

[73] Assignee: AGFA-Gevaert, N.V., Mortsel, Belgium

[21] Appl. No.: 138,257

[22] Filed: Oct. 20, 1993

[30] Foreign Application Priority Data

Oct. 20, 1992 [EP] European Pat. Off. ..... 92203209

[51] Int. Cl.[6] ..... B41M 5/035; B41M 5/38

[52] U.S. Cl. ..... 503/227; 428/195; 428/500; 428/913; 428/914

[58] Field of Search ..... 8/471; 428/195, 500, 428/913, 914; 503/227

[56] References Cited

FOREIGN PATENT DOCUMENTS 60-28452 2/1985 Japan ..... 503/227

*Primary Examiner*—B. Hamilton Hess

*Attorney, Agent, or Firm*—Breiner & Breiner

[57] ABSTRACT

Dye-donor element for use according to thermal dye transfer methods, said element said element comprising a support having thereon a dye layer comprising a combination of dyes, wherein the constituting dyes of said combination comprise at least one yellow and/or at least one cyan dye as well as at least one magenta dye of the class of N-alkyl-N-aryl-substituted tricyanovinylaniline dyes. By means of this dye-donor element dye images are obtained, which show a substantially reduced catalytic fading effect in the red and blue shades, have a high light-fastness, and show vivid blue and vivid red and orange colors in the full color area.

9 Claims, No Drawings

DYE-DONOR ELEMENT COMPRISING MAGENTA-COLOURED TRICYANOVINYLANILINE DYES

DESCRIPTION

1. Field of the Invention

The present invention relates to dye-donor elements for use according to thermal dye sublimation transfer.

2. Background of the Invention

Thermal dye transfer methods include thermal dye sublimation transfer also called thermal dye diffusion transfer. This is a recording method in which a dye-donor element provided with a dye layer containing sublimating dyes having heat transferability is brought into contact with a receiver sheet and selectively, in accordance with a pattern information signal, heated with a thermal printing head provided with a plurality of juxtaposed heat-generating resistors, whereby dye is transferred from the selectively heated regions of the dye-donor element to the receiver sheet and forms a pattern thereon, the shape and density of which are in accordance with the pattern and intensity of heat applied to the dye-donor element.

A dye-donor element for use according to thermal dye sublimation transfer usually comprises a very thin support e.g. a polyester support, one side of which is covered with a dye layer comprising the printing dyes. Usually, an adhesive or subbing layer is provided between the support and the dye layer. Normally, the opposite side of the support is covered with a slipping layer that provides a lubricated surface against which the thermal printing head can pass without suffering abrasion. An adhesive layer may be provided between the support and the slipping layer.

The dye layer can be a monochromic dye layer or it may comprise sequential repeating areas of differently coloured dyes e.g. dyes having a cyan, magenta, yellow, and optionally black hue. When a dye-donor element containing three or more primary colour dyes is used, a multicolour image can be obtained by sequentially performing the dye transfer process steps for each colour.

A primary coloured dye layer e.g. a magenta or cyan or yellow dye layer may comprise only one primary coloured dye (a magenta, cyan, or yellow dye respectively) or may comprise a mixture of at least two yellow dyes respectively).

When multicolour images or multicolour reproductions are made with the so-called substractive colours yellow, magenta, and cyan, the spectral absorption characteristics of the magenta colour dye employed are of great importance. In fact, the side absorptions of the magenta colour dye determine whether it is possible to obtain vivid blue and vivid red and orange colours.

Magenta colour dyes satisfying the spectral requirements can be found in the class of the so-called tricyanovinylaniline dyes. These colour dyes have been described for transfer printing on fabrics in U.S. Pat. No. 4,159,192 and for use in thermal transfer recording in JP 60 031 563, JP 02-241 786 and in EP 441,396 and EP 279,467.

However, the poor light-fastness of the known tricyanovinylaniline dyes used for thermal printing has been emphasized in Chemistry and Industry, 16 Oct. 1989, p. 682, FIG. 7.

The use of known magenta tricyanovinylaniline dyes has further inconveniences as explained hereinafter. The so-called additive colours green, red, and blue in the prints are obtained by sequentially printing the primary colours on one another, e.g. for green: cyan and yellow; for blue: cyan and magenta; and for red: magenta and yellow, so that the resulting shades are in fact built up by mixtures of dyes.

Unfortunately, dye images that have been transferred from dye-donor elements and contain mixtures of dyes frequently show an increased fading rate owing to a photochemical effect known as catalytic fading of dye mixtures.

This phenomenon has been investigated in textile dyeing by Rembold and Kramer cfr. Journal of the Society of Dyers and Colourists, vol. 94 (1978), pages 12–17 and by Asquith and Ingham cfr. Journal of the Society of Dyers and Colourists, vol. 89 (1973), pages 81–85. It has been established indeed that the light-fastness of a single dye applied to textiles is often much better than that of mixed dyes. In most of the reported cases, the light-fastness of cyan, violet, or red dyes deteriorates when a yellow dye is added.

The N,N-dialkyl-substituted tricyanovinylaniline dyes used so far unfortunately show a high catalytic fading effect when in mixed state with other dyes to form red and blue image shades.

SUMMARY OF THE INVENTION

It is therefore an object of the present invention to provide dye-donor elements comprising magenta N-alkyl-N-aryl-substituted tricyanovinylaniline dyes and yellow and/or cyan dyes, which together after thermal transfer thereof to a receiver sheet yield mixed dye images showing a substantially reduced catalytic fading effect in the red and blue shades.

It is another object of the present invention to provide dye-donor elements that upon thermal transfer of said magenta N-alkyl-N-aryl-substituted tricyanovinylaniline dyes and yellow and/or cyan dyes to a receiver sheet yield mixed dye images having a high light-fastness and showing vivid blue and vivid red and orange colours in the full colour areas.

Further objects will become apparent from the description hereinafter.

According to the present invention a dye-donor element for use according to thermal dye transfer methods is provided, said element comprising a support having thereon a dye layer comprising a combination of dyes, wherein the constituting dyes of said combination comprise at least one yellow and/or at least one cyan dye as well as at least one magenta dye, said magenta dye corresponds to the general formula (I):

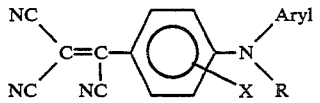

(I)

wherein:

X represents hydrogen or a substituent,

Aryl represents a phenyl group or a substituted phenyl group, and

R represents methyl, substituted methyl, an alkyl group having a branched carbon chain or an unbranched carbon chain, a substituted alkyl group having a branched carbon chain or an unbranched carbon chain group, a cycloalkyl group, or a substituted cycloalkyl group;

said yellow dye corresponds to the general formula (II):

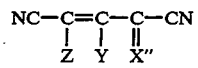

(II)

wherein:

Z represents CN, $COOR^9$, or $CONR^{10}R^{11}$;

$R^9$, $R^{10}$, and $R^{11}$ each independently represent hydrogen, substituted or unsubstituted alkyl, substituted or unsubstituted cylcloalkyl, substituted or unsubstituted aryl, or $R^{10}$ and $R^{11}$ together represent the atoms needed to complete a heterocyclic nucleus or substituted heterocyclic nucleus;

Y represents $OR^{12}$ or $NR^{13}R^{14}$, or CN;

$R^{12}$ represents hydrogen, substituted or unsubstituted alkyl, substituted or unsubstituted cycloalkyl, substituted or unsubstituted aryl $SO_2R^{15}$, $COR^{15}$, $CSR^{15}$, or $POR^{15}R^{16}$;

$R^{13}$ and $R^{14}$ each independently represents hydrogen, substituted or unsubstituted alkyl, substituted or unsubstituted cycloalkyl, substituted or unsubstituted aryl, substituted or unsubstituted amino $SO_2R^{15}$, $COR^{15}$, $CSR^{15}$, $POR^{15}R^{16}$, or $R^{13}$ and $R^{14}$ together represent the atoms needed to complete a heterocyclic nucleus or substituted heterocyclic nucleus or a heterocyclic nucleus with an aliphatic or aromatic ring fused-on;

$R^{15}$ and $R^{16}$ each independently represent substituted or unsubstituted alkyl, substituted or unsubstituted cycloalkyl, substituted or unsubstituted alkenyl, substituted or unsubstituted aralkyl, substituted or unsubstituted aryl, substituted or unsubstituted alkyloxy, substituted or unsubstituted aryloxy, substituted or unsubstituted alkylthio, substituted or unsubstituted arylthio; substituted or unsubstituted amino, or a substituted or unsubstituted heterocyclic group, or $R^{15}$ and $R^{16}$ together represent the atoms needed to complete a 5- or 6-membered ring;

X'' represents $CR^{17}R^{18}$; and $R^{17}$ and $R^{18}$ each independently represent hydrogen, substituted or unsubstituted alkyl, substituted or unsubstituted cycloalkyl, substituted or unsubstituted aryl, substituted or unsubstituted alkenyl, substituted or unsubstituted alkynyl, a substituted or unsubstituted heterocyclic ring, cyano, halogen, $SO_2R^{15}$, $COR^{15}$, $CSR^{15}$, $POR^{15}R^{16}$, or $R^{17}$ and $R^{18}$ together represent the atoms needed to complete a substituted or unsubstituted ring.

The present invention also provides a receiver sheet carrying a heat-transferred dye combination, wherein the constituting dyes of said combination comprise at least one yellow dye according to formula (II) above and/or at least one cyan dye as well as at least one magenta dye corresponding to the above general formula (I).

The present invention further also provides a method of forming an image, having high light-fastness and poor catalytic fading effect, by thermal transfer of a combination of dyes from a dye-donor element to a receiver sheet, wherein the constituting dyes of said combination comprise at least one yellow dye according to formula (II) above and/or at least one cyan dye as well as at least one magenta dye of the class of tricyanovinylaniline dyes corresponding to the above general formula (I).

According to a preferred embodiment of the method of the present invention for forming an image, which image shows a low catalytic fading effect, the repeating areas of cyan dye in the dye-donor element comprise at least one azomethine cyan dye corresponding to the following general formula (II bis): least one azomethine cyan dye corresponding to the following general formula (II bis):

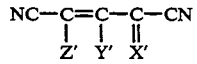

(II bis)

as described in U.S. Pat. No. 5,026,677, the disclosure of which is hereby incorporated by reference, in combination with at least one magenta dye corresponding to the above general formula (I) in the magenta repeating areas of the dyedonor element, the symbols Z', Y', and X' in general formula (II bis) having the following signification:

Z' represents CN, $COOR^{19}$, or $CONR^{20}R^{21}$;

$R^{19}$, $R^{20}$, and $R^{21}$ each independently represent hydrogen, substituted or unsubstituted alkyl, substituted or unsubstituted cycloalkyl, substituted or unsubstituted aryl, or $R^{20}$ and $R^{21}$ together represent the atoms needed to complete a heterocyclic nucleus or substituted heterocyclic nucleus;

Y' represents $OR^{22}$ or $NR^{23}R^{24}$ or CN;

$R^{22}$ represents hydrogen, substituted or unsubstituted alkyl, substituted or unsubstituted cycloalkyl, substituted or unsubstituted aryl $SO_2R^{25}$, $COR^{25}$, $CSR^{25}$, or $POR^{25}$, $R^{26}$, $R^{23}$ and $R^{24}$ each independently represents hydrogen, substituted or unsubstituted alkyl, substituted or unsubstituted cycloalkyl, substituted or unsubstituted aryl, substituted Or unsubstituted amino, $SO_2R^{25}$, $COR^{25}$, $CSR^{25}$, or $POR^{25}$, $R^{26}$ or $R^{23}$ and $R^{24}$ together represent the atoms needed to complete a heterocyclic nucleus or substituted heterocyclic nucleus or a heterocyclic nucleus with an aliphatic or aromatic ring fused-on;

$R^{25}$ and $R^{26}$ each independently represent substituted or unsubstituted alkyl, substituted or unsubstituted cycloalkyl, substituted or unsubstituted alkenyl, substituted or unsubstituted aralkyl, substituted or unsubstituted aryl, substituted or unsubstituted alkyloxy, substituted or unsubstituted aryloxy, substituted or unsubstituted alkylthio, substituted or unsubstituted arylthio, substituted or unsubstituted amino, or a substituted or unsubstituted heterocyclic group, or $R^{25}$ and $R^{26}$ together represent the atoms needed to complete a 5- or 6-membered ring;

X' represents N-Ar or −N-Het;

Ar represents an aromatic nucleus substituted in para position by a substituent chosen from the group consisting of substituted or unsubstituted amino, substituted or unsubstituted alkyloxy, substituted or unsubstituted aryloxy, substituted or unsubstituted alkylthio, substituted or unsubstituted arylthio, hydroxy, or mercapto; and Het represents a substituted or unsubstituted heterocyclic ring.

A preferred representative of the azomethine cyan dyes corresponding to the above general formula (II bis) is the cyan dye CO2 identified in Table 4 hereinafter.

According to a preferred embodiment of the method of the present invention for forming an image, which image has a low catalytic fading effect, the repeating areas of cyan dye in the dye-donor element comprise at least one cyan indoaniline dye corresponding to the following general formula (III) in combination with at least one magenta dye corresponding to the above general formula (I) in the magenta repeating areas of the dye-donor element:

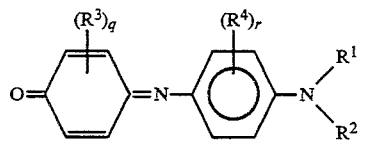

(III)

wherein:

$R^1$ and $R^2$ (same or different) represent hydrogen, an alkyl group, a cycloalkyl group, an aryl group, an allyl group, or an alkenyl group, which groups may carry at least one substituent, or $R^1$ and $R^2$ together with the nitrogen to which they are attached form the necessary atoms to complete a 5- or 6-membered heterocyclic ring, which ring may carry at least one substituent, or $R^1$ and/or $R^2$ together with the nitrogen to which they are attached and either or both carbon atoms in ortho-position on the phenyl ring with respect to said nitrogen atom form a 5- or 6-membered heterocyclic ring, which ring may carry at least one substituent;

$R^3$ represents a halogen atom, hydroxy, cyano, an alkyl group, a cycloalkyl group, an aryl group, an alkoxy group, an aryloxy group, an alkylthio group, an arylthio group, an amino group, nitro, an alkylcarbamoyl group, an arylcarbamoyl group, an arylsulfamoyl group, an alkylcarbamoyl group, an aryloxycarbamoyl group, an alkylthiocarbamoyl group, an arylthiocarbamoyl group, an alkylphosphoramidate group, an arylphosphoramidate group, an alkylphosphonamidate group, an arylphosphonamidate group, an alkylaminocarbonyl group or an arylaminocarbonyl group, which groups may carry at least one substituent, or $R^3$ represents the necessary atoms to close an alicyclic or aromatic or heterocyclic ring (which ring may carry at least one substituent) fused-on the cyclohexadiene ring;

q represents 0, 1, 2, 3, or 4, the $R^3$ substituents being the same or different when $q>1$;

$R^4$ can have any of the significances given above for $R^3$ or can represent the necessary atoms to complete an alicyclic or aromatic or heterocyclic ring (which ring may carry at least one substituent) fused-on the benzene ring; and r represents 0, 1, 2, 3 or 4, the $R^4$ substituents being the same or different when $r>1$.

According to another preferred embodiment of the method of the present invention for forming an image, which image shows blue shades having a low catalytic fading effect, the repeating areas of cyan dye in the dye-donor element comprise at least one cyan azo dye corresponding to the following general formula (IV) in combination with at least one magenta dye corresponding to the above general formula (I) in the magenta repeating areas of the dye-donor element:

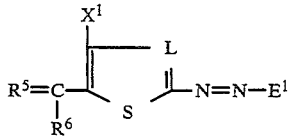

(IV)

wherein:

$R^5$ is the residue of an active methylene compound, $R^6$ is hydrogen or cyano, $X^1$ is hydrogen or a substituent, L is =N- or

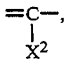

$X^2$ is hydrogen or a substituent, and $E^1$ is the residue of a coupler compound.

Dyes corresponding to the above general formula (IV) have been described in EP 352,006, EP 344,592, EP 302,628, in the European Patent Applications 92202155.5 and 92202156.3.

According to another preferred embodiment of the method of the present invention for forming an image, which image shows blue shades having a low catalytic fading effect, the repeating areas of cyan dye in the dye-donor element comprise at least one cyan bis azo dye corresponding to the following general formula (V) in combination with at least one magenta dye corresponding to the above general formula (I) in the magenta repeating areas of the dye-donor element:

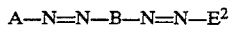

$$A-N=N-B-N=N-E^2 \quad (V)$$

wherein:

A is the residue of a diazotizable aniline or substituted diazotizable aniline,

B is an optionally substituted thiophen-2,5-ylene or thiazol-2,5-ylene linking group, $E^2$ is the residue of an aromatic coupler compound.

Colour dyes corresponding to the above general formula (V) have been described in EP 218,397 and in U.S. Pat. No. 4,743,581.

DETAILED DESCRIPTION OF THE INVENTION

The dyes corresponding to the above general formula (I) can be prepared according to etablished synthetic procedures known e.g. from U.S. Pat. No. 2,762,810 and JACS, 80 (1958) pages 2806–15 and from JP 60/31,563. A known method is the condensation of the appropriately substituted aniline with tetracyanoethylene.

Magenta N-alkyl-N-aryl-substituted tricyanovinylaniline dyes for use in accordance with the present invention, which correspond to the above general formula (I), include the following listed in Table 1.

TABLE 1
| Dye n° | X | R | Aryl |
|---|---|---|---|
| M01 | H | $C_4H_9$— | 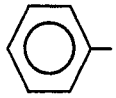 |
| M02 | H | " | $H_5C_2$— 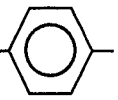 |
| M03 | H | " | $H_3CO$— 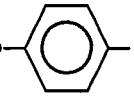 |
| M04 | H | 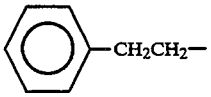 $CH_2CH_2$— | 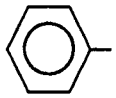 |
| M05 | H | $C_4H_9$— | $CH_3OCH_2CH_2O$— 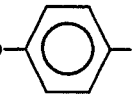 |
| M06 | H | $CH_3OCH_2CH_2$— | $H_3CO$— 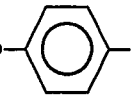 |
| M07 | H | $CH_2OCH_2CH_2$— | 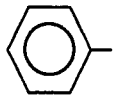 |
| M08 | H | $H_5C_2$ 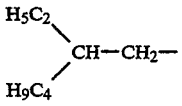 $H_9C_4$ | 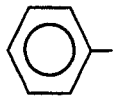 |
| M09 | H | $H_3C$ 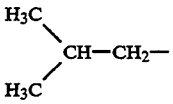 $H_3C$ | $CH_3OCH_2CH_2O$— 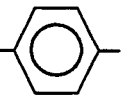 |
| M10 | H | $H_3C$ 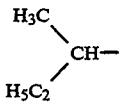 $H_5C_2$ | 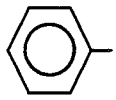 |
| M11 | H | $H_3C$ 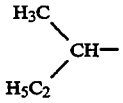 $H_5C_2$ | $H_5C_2$— 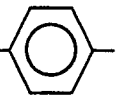 |
| M12 | H | $H_3C$ 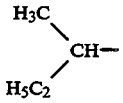 $H_5C_2$ | $CH_3O$— 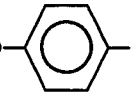 |
| M13 | H | $H_3C$ 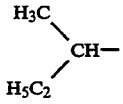 $H_5C_2$ | $CH_3OCH_2CH_2O$— 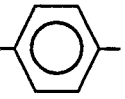 |

TABLE 1-continued

| Dye n° | X | R | Aryl |
|---|---|---|---|
| M14 | H | 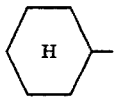 | 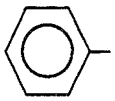 |
| M15 | $CH_3$— | 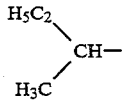 | 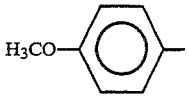 |
| M16 | $CH_3O$— | 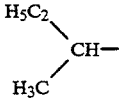 | 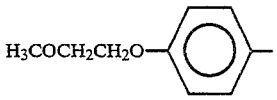 |
| M17 | H | $(H_3C)_2CH$— | 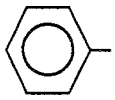 |
| M18 | H | 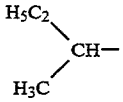 | 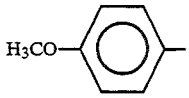 |
| M19 | H | 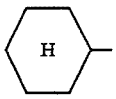 | 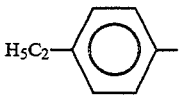 |
| M20 | H | $CH_3OCH_2CH_2OCH_2CH_2$— | 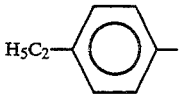 |
| M21 | H | $CH_3OCH_2CH_2$— | 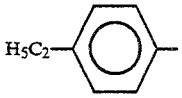 |
| M22 | H | 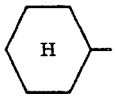 | 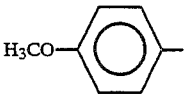 |
| M23 | H | 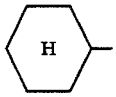 | 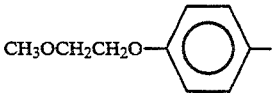 |

It has been established that the N-alkyl-N-aryl-substituted tricyanovinylaniline dyes corresponding to the general formula I, when in mixed state on the receiver sheet with at least one yellow dye according to formula (II) and/or at least one cyan dye to form red and blue image shades, enjoy a substantially reduced catalytic fading effect and a very good light-fastness. Moreover, vivid blue and vivid red and orange colours can be obtained in the full colour areas on the receiver sheet after thermal diffusion of the combination of dyes according to the present invention.

The dye layer of the dye-donor element is formed preferably by adding the dyes, a polymeric binder medium, and other optional components to a suitable solvent or solvent mixture, dissolving or dispersing these ingredients to form a coating composition that is applied to a support, which may have been provided first with an adhesive or subbing layer, and dried.

The dye layer thus formed generally has a thickness of about 0.2 to 5.0 μm, preferably 0.4 to 2.0 μm, and the amount ratio of dye to binder generally ranges from 9:1 to 1:3 weight, preferably from 3:1 to 1:2 by weight.

The following polymers can be used as polymeric binder: cellulose derivatives, such as ethyl cellulose, hydroxyethyl cellulose, ethylhydroxy cellulose, ethyl hydroxyethyl cellulose, hydroxypropyl cellulose, methyl cellulose, cellulose nitrate, cellulose acetate formate, cellulose acetate hydrogen phthalate, cellulose acetate, cellulose acetate propionate, cellulose acetate butyrate, cellulose acetate pentanoate, cellulose acetate benzoate, cellulose triacetate; vinyl-type resins and derivatives, such as polyvinyl alcohol, polyvinyl acetate, polyvinyl butyral, copolyvinyl butyralvinyl acetal-vinyl alcohol, polyvinyl pyrrolidone, polyvinyl acetoacetal, polyacrylamide; polymers and copolymers derived from acrylates and acrylate derivatives, such as polyacrylic acid, polymethyl methacrylate and styrene-acrylate copolymers; polyester resins; polycarbonates; copolystyrene-acrylonitrile; polysulfones; polyphenylene oxide; organosilicones, such as polysiloxanes; epoxy resins and natural resins, such as gum arabic. Preferably, the binder for the dye layer of the present invention comprises cellulose acetate butyrate or copolystyrene-acrylonitrile.

The dye-donor element of the present invention can be used for the recording of a coloured image together with primary colour dye-donor elements comprising respectively a magenta dye or a mixture of magenta dyes, a cyan dye or a mixture of cyan dyes and a yellow dye or a mixture of yellow dyes.

The coating layer may also contain other additives, such as curing agents, preservatives, organic or inorganic fine particles, dispersing agents, antistatic agents, defoaming agents, viscosity-controlling agents, these and other ingredients having been described more fully in EP 133,011, EP 133,012, EP 111,004, and EP 279,467.

Any material can be used as the support for the dye-donor element provided it is dimensionally stable and capable of withstanding the temperatures involved, up to 400° C. over a period of up to 20 msec, and is yet thin enough to transmit heat applied on one side through to the dye on the other side to effect transfer to the receiver sheet within such short periods, typically from 1 to 10 msec. Such materials include polyesters such as polyethylene terephthalate, polyamides, polyacrylates, polycarbonates, cellulose esters, fluorinated polymers, polyethers, polyacetals, polyolefins, polyimides, glassine paper and condenser paper. Preference is given to a support comprising polyethylene terephthalate. In general, the support has a thickness of 2 to 30 $\mu$m. The support may also be coated with an adhesive of subbing layer, if desired.

The dye layer of the dye-donor element can be coated on the support or printed thereon by a printing technique such as a gravure process.

A dye-barrier layer comprising a hydrophilic polymer may also be employed between the support and the dye layer of the dye-donor element to enhance the dye transfer densities by preventing wrong-way transfer of dye backwards to the support. The dye barrier layer may contain any hydrophilic material that is useful for the intended purpose. In general, good results have been obtained with gelatin, polyacrylamide, polyisopropyl acrylamide, butyl methacrylate-grafted gelatin, ethyl methacrylate-grafted gelatin, ethyl acrylate-grafted gelatin, cellulose monoacetate, methylcellulose, polyvinyl alcohol, polyethyleneimine, polyacrylic acid, a mixture of polyvinyl alcohol and polyvinyl acetate, a mixture of polyvinyl alcohol and polyacrylic acid, or a mixture of cellulose monoacetate and polyacrylic acid. Suitable dye barrier layers have been described in e.g. EP 227,091 and EP 228,065. Certain hydrophilic polymers e.g. those described in EP 227,091 also have an adequate adhesion to the support and the dye layer, so that the need for a separate adhesive or subbing layer is avoided. These particular hydrophilic polymers used in a single layer in the dye-donor element thus perform a dual function, hence are referred to as dye-barrier/subbing layers.

Preferably the reverse side of the dye-donor element has been coated with a slipping layer to prevent the printing head from sticking to the dye-donor element. Such a slipping layer would comprise a lubricating material such as a surface-active agent, a liquid lubricant, a solid lubricant or mixtures thereof, with or without a polymeric binder. The surface-active agents may be any agents known in the art such as carboxylates, sulfonates, phosphates, aliphatic amine salts, aliphatic quaternary ammonium salts, polyoxyethylene alkyl ethers, polyethylene glycol fatty acid esters, fluoroalkyl $C_2$–$C_{20}$ aliphatic acids. Examples of liquid lubricants include silicone oils, synthetic oils, saturated hydrocarbons, and glycols. Examples of solid lubricants include various higher alcohols such as stearyl alcohol, fatty acids and fatty acid exters. Suitable, slipping layers have been described in e.g. EP 138,483, EP 227,090, U.S. Pat. Nos. 4,567,113, 4,572,860, 4,717,711. Preferably the slipping layer comprises a styrene-acrylonitrile copolymer or a styrene-acrylonitrile-butadiene copolymer or a mixture thereof for a polycarbonate as described in European patent application no. 91202071.6 and in the corresponding U.S. Pat. No. 5,234,888 as binder and a polysiloxane-polyether copolymer or polytetrafluoroethylene or a mixture thereof as lubricant in an amount of 0.1 to 10% by weight of the binder or binder mixture.

The support for the receiver sheet that is used with the dye-donor element may be a transparent film of e.g. polyethylene terephthalate, a polyether sulfone, a polyimide, a cellulose ester or a polyvinyl alcohol-co-acetal. The support may also be a reflective one such as a baryta-coated paper, polyethylene-coated paper or white polyester i.e. white-pigmented polyester. Blue-coloured polyethylene terephthalate film can also be used as support.

To avoid poor adsorption of the transferred dye to the support of the receiver sheet this support must be coated with a special layer called dye-image-receiving layer, into which the dye can diffuse more readily. The dye-image-receiving layer may comprise e.g. a polycarbonate, a polyurethane, a polyester, a polyamide, polyvinyl chloride, polystyrene-co-acrylonitrile, polycaprolactone, or mixtures thereof. Preferably, the receiver sheet carries a dye-image-receiving layer comprising polyvinyl chloride. The dye-image-receiving layer may also comprise a heat-cured product of poly(vinyl chloride/co-vinyl acetate/co-vinyl alcohol)and polyisocyanate. Suitable dye-image-receiving layers have been described in e.g. EP 133,011, EP 133,012, EP 144,247, EP 227,094, and EP 228,066.

In order to improve the light-fastness and other stabilities of recorded images UV-absorbers, singlet oxygen quenchers such as HALS-compounds (Hindered Amine Light Stabilizers) and/or antioxidants can be incorporated into the dye-image-receiving layer.

The dye layer of the dye-donor element or the dye-image-receiving layer of the receiver sheet may also contain a releasing agent that aids in separating the dye-donor element from the receiver sheet after transfer. The releasing agents can also be incorporated in a separate layer on at least part of the dye layer and/or Of the dye-image-receiving layer. Suitable releasing agents are solid waxes, fluorine- or phosphate-containing surface-active agents and silicone oils. Suitable releasing agents have been described in e.g. EP 133,012, JP 85/19,138, and EP 227,092.

The dye-donor elements according to the invention are used to form a dye transfer image, which process comprises placing the dye layer of the dye-donor element in face-to-face relation with the dye-image-receiving layer of the receiver sheet and image-wise heating from the back of the dye-donor element. The transfer of the dye is accomplished by heating for about several milliseconds at a temperature of 400° C.

When the process is performed for but one single colour, a monochromic dye transfer image is obtained. A multicolour image can be obtained by using a dye-donor element containing three or more primary colour dyes and sequentially performing the process steps described above for each colour. The above sandwich of dye-donor element and receiver sheet is formed on three occasions during the time when heat is applied by the thermal printing head. After the first dye has been transferred, the elements are peeled apart. A second dye-donor element (or another area of the dye-donor element with a different dye area) is then brought in register with the dye-receiving element and the process is repeated. The third colour and optionally further colours are obtained in the same manner.

In addition to thermal heads, laser light, infrared flash, or heated pens can be used as the heat source for supplying heat energy. Thermal printing heads that can be used to transfer dye from the dye-donor elements of the present invention to a receiver sheet are commercially available. In case laser light is used, the dye layer or another layer of the dye element has to contain a compound that absorbs the light emitted by the laser and converts it into heat e.g. carbon black.

Alternatively, the support of the dye-donor element may be an electrically resistive ribbon consisting of e.g. a multilayer structure of a carbon-loaded polycarbonate coated with a thin aluminium film. Current is injected into the resistive ribbon by electrically addressing a printing head electrode resulting in highly localized heating of the ribbon beneath the relevant electrode. The fact that in this case the heat is generated directly in the resistive ribbon and that it is thus the ribbon that gets hot leads to an inherent advantage in printing speed using the resistive ribbon/electrode head technology as compared to the thermal head technology, according to which the various elements of the thermal head get hot and must cool down before the head can move to the next printing position.

The following example illustrates the invention in more detail without, however, limiting the scope thereof.

EXAMPLE

Receiver sheets were prepared by coating a subbed polyethylene terephthalate film support having a thickness of 175 μm with a dye-image-receiving layer from a solution in ethyl methyl ketone of 3,6 g/m$^2$ of poly(vinyl chloride/co-vinyl acetate/co-vinyl alcohol) (Vinylite VAGD supplied by Union Carbide), 0,336 g/m$^2$ of diisocyanate (Desmodur N3300 supplied by Bayer AG), and 0,2 g/m$^2$ of hydroxy-modified polydimethylsiloxane (Tegomer H SI 2111 supplied by Goldschmidt).

Dye-donor elements for use according to thermal dye sublimation transfer were prepared as follows.

A solution comprising 0.2% by weight of dye and 0.5% by weight of of poly(styrene-co-acrylonitrile) (Luran 388S, supplied by BASF Germany) as binder in methyl ethyl ketone was prepared.

From this solution a dye layer having a wet thickness of 100 μm was coated on a polyethylene terephthalate film support having a thickness of 6 μm and carrying a conventional subbing layer. The resulting dye layer was dried by evaporation of the solvent.

The opposite side of the film support was coated with a subbing layer of a copolyester comprising ethylene glycol, adipic acid, neopentyl glycol, terephthalic acid, isophthalic acid, and glycerol.

The resulting subbing layer was covered with a a solution in methyl ethyl ketone of 0.5 g/m$^2$ of a polycarbonate having the following structural formula to form a heat- resistant layer:

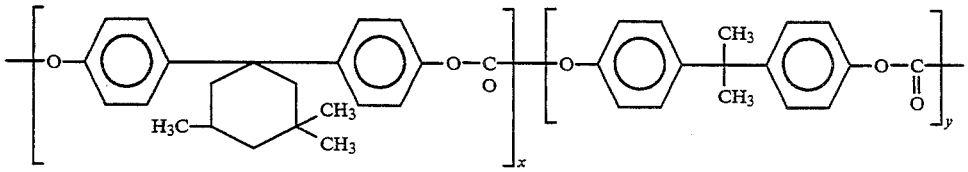

wherein x=55 mol % and y=45 mol %.

Finally, a top layer of polyether-modified polydimethylsiloxane (Tegoglide 410, Goldschmidt) was coated from a solution in isopropanol on the resulting heat-resistant polycarbonate layer.

The dye-donor element was printed in combination with a receiver sheet in a Mitsubishi colour video printer CP100E.

The additive colour red was obtained by printing magenta dye in combination with yellow dye on one another, whereas the additive colour blue was obtained by printing magenta dye in combination with cyan dye also on one another.

The receiver sheet was separated from the dye-donor element and the colour density value of the recorded image was measured by means of a Macbeth TR 924 densitometer in the red, green, and blue region in a status A mode.

The above described experiment was repeated for each of the dye mixtures identified in the Tables 5 and 6 hereinafter.

Finally, each receiver sheet was subjected to irradiation by means of a xenon lamp of 150 klux for a time indicated in hours in Table 3. The colour density values were measured again and the densy loss or gain (in %) was calculated and listed in the Tables 5 and 6.

In Table 2 the structure of known magenta N,N-dialkyl-substituted tricyanovinylanline dyes used as comparison examples CM01 to CM04 is given These comparison dyes correspond o the following formula (V):

TABLE 2

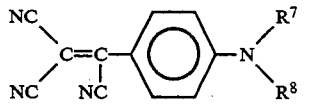

(VI)

| Comparison dye N° | $R^7$ | $R^8$ |
|---|---|---|
| CM01 | $C_4H_9$— | $C_4H_9$— |
| CM02 | $C_4H_9$— | 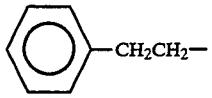 |
| CM03 | $C_4H_9$— | 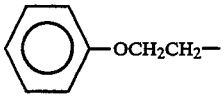 |
| CM04 | $C_4H_9$— | HO—$CH_2CH_2$— |

A yellow dye according to formula (II) for combination with magenta tricyanovinylaniline dyes is as follows:

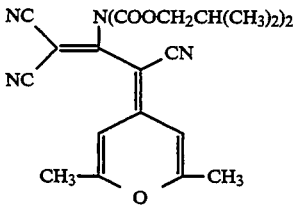

YO1

In Table 3 cyan dyes that can be combined with magenta tricyanovinylaniline dyes for obtaining the blue mixtures are listed.

TABLE 3

| Dye N° | |
|---|---|
| C01 | 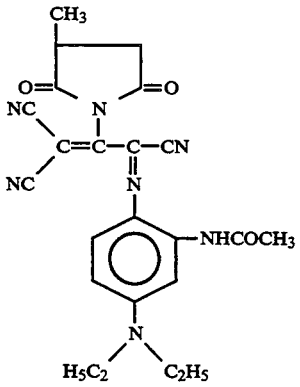 |

TABLE 3-continued

| Dye N° | |
|---|---|
| C02 | 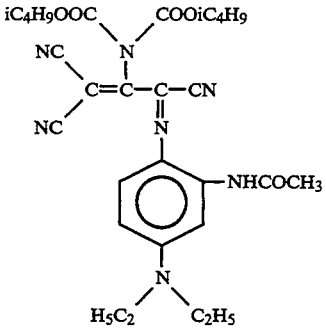 |
| C03 | 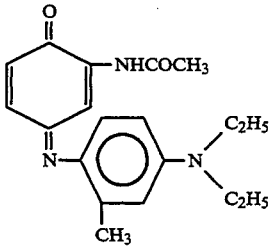 |
| C04 | 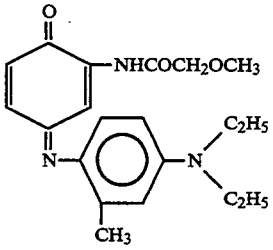 |
| C05 | 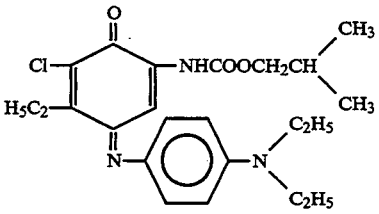 |
| C06 | 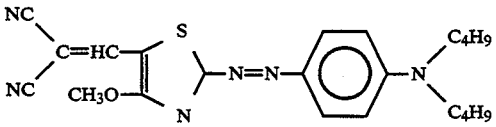 |
| C07 | 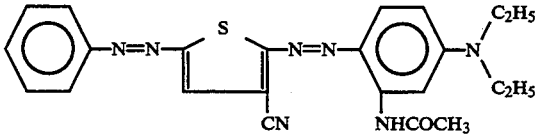 |

described in U.S. Pat. No. 4,743,581

TABLE 3-continued

| Dye N° | |
|---|---|
| C08 | 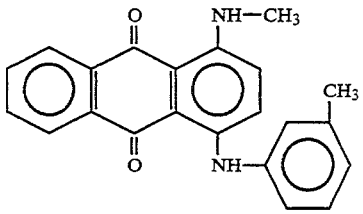 |
| | described in U.S. Pat. No. 4,824,437 |

Table 4 gives the values of catalytic fading effect measured for the red combinations.

TABLE 4

| | Combined dyes forming red | Density loss in % after xenon irradiation through a green filter for 4 h | 12 h | 28 h |
|---|---|---|---|---|
| COMPARISON | Y01 + CM01 | −17 | −52 | −85 |
| | Y01 + CM02 | −30 | −69 | −89 |
| | Y01 + CM03 | −14 | −47 | −81 |
| | Y01 + CM04 | −38 | −72 | −89 |
| INVENTION | Y01 + M04 | 00 | −02 | −67 |
| | Y01 + M05 | −02 | −08 | −48 |
| | Y01 + M07 | −09 | −20 | −62 |
| | Y01 + M12 | −03 | −09 | −42 |
| | Y01 + M20 | −05 | −26 | −75 |
| | Y01 + M21 | −03 | −19 | −70 |

| | Combined dyes forming red | Density loss in % after xenon irradiation through a blue filter for 4 h | 12 h | 28 h |
|---|---|---|---|---|
| COMPARISON | Y01 + CM01 | −01 | −12 | −47 |
| | Y01 + CM02 | −04 | −26 | −54 |
| | Y01 + CM03 | −04 | −17 | −47 |
| | Y01 + CM04 | −05 | −19 | −64 |
| INVENTION | Y01 + M04 | −04 | −05 | −39 |
| | Y01 + M05 | −00 | −00 | −04 |
| | Y01 + M07 | −00 | −05 | −29 |
| | Y01 + M12 | −00 | −05 | −15 |
| | Y01 + M20 | −03 | −04 | −38 |
| | Y01 + M21 | −00 | −03 | −34 |

Table 5 gives the values of catalytic fading effect measured for the blue combinations.

TABLE 5

| | Combined dyes forming blue | Density loss in % after xenon irradiation through a red filter for 4 h | 12 h | 28 h |
|---|---|---|---|---|
| COMPARISON | C01 + CM02 | −05 | −18 | −52 |
| | C01 + CM03 | −05 | −16 | −46 |
| | C01 + CM04 | −04 | −16 | −55 |
| INVENTION | C01 + M05 | −03 | −15 | −35 |
| | C01 + M07 | −05 | −16 | −37 |
| | C01 + M12 | −03 | −13 | −27 |
| | C01 + M20 | −02 | −11 | −30 |
| | C01 + M21 | −03 | −13 | −31 |
| COMPARISON | C02 + CM01 | −10 | −28 | −81 |
| | C02 + CM02 | −11 | −28 | −92 |
| | C02 + CM03 | −13 | −45 | −99 |
| INVENTION | C02 + M04 | −09 | −25 | −78 |
| | C02 + M05 | −06 | −22 | −57 |
| | C02 + M12 | −08 | −26 | −69 |
| COMPARISON | C04 + CM02 | −11 | −28 | −59 |
| | C04 + CM04 | −20 | −37 | −63 |
| INVENTION | C04 + M04 | −10 | −24 | −64 |
| | C04 + M05 | −11 | −23 | −51 |
| | C04 + M07 | −10 | −24 | −57 |
| | C04 + M12 | −10 | −27 | −56 |
| | C04 + M20 | −10 | −26 | −59 |
| COMPARISON | C06 + CM01 | −05 | −09 | −24 |
| | C06 + CM02 | −02 | −05 | −24 |
| INVENTION | C06 + M05 | −03 | −05 | −16 |
| | C06 + M06 | −03 | −04 | −13 |
| | C06 + M07 | −02 | −04 | −12 |
| | C06 + M12 | −02 | −04 | −13 |
| | C06 + M20 | −02 | −05 | −15 |
| COMPARISON | C07 + C08 + CM01 | −03 | −07 | −17 |
| | C07 + C08 + CM02 | −02 | −06 | −21 |
| INVENTION | C07 + C08 + M05 | −03 | −05 | −13 |
| | C07 + C08 + M06 | −02 | −04 | −11 |
| | C07 + C08 + M20 | −02 | −06 | −14 |
| COMPARISON | C08 + CM01 | −03 | −05 | −13 |
| | C08 + CM02 | −03 | −05 | −19 |
| INVENTION | C08 + M06 | −02 | −02 | −14 |
| | C08 + M07 | −02 | −06 | −16 |
| | C08 + M12 | −04 | −06 | −16 |
| | C08 + M20 | −04 | −07 | −15 |

| | Combined dyes forming blue | Density loss in % after xenon irradiation through a green filter for 4 h | 12 h | 28 h |
|---|---|---|---|---|
| COMPARISON | C01 + CM02 | −02 | −10 | −36 |
| | C01 + CM03 | −02 | −07 | −27 |
| | C01 + CM04 | −03 | −13 | −48 |
| INVENTION | C01 + M04 | 00 | −05 | −20 |
| | C01 + M05 | −01 | −08 | −24 |
| | C01 + M07 | −02 | −08 | −19 |
| | C01 + M12 | 00 | −04 | −12 |
| | C01 + M20 | 00 | −04 | −17 |
| | C01 + M21 | −02 | −07 | −21 |
| COMPARISON | C02 + CM01 | −02 | −08 | −40 |
| | C02 + CM02 | −02 | −10 | −53 |
| | C02 + CM03 | −04 | −16 | −68 |
| INVENTION | C02 + M04 | 00 | −06 | −31 |
| | C02 + M05 | 00 | −06 | −28 |
| | C02 + M12 | −02 | −07 | −29 |
| COMPARISON | C04 + CM01 | −03 | −07 | −51 |
| | C04 + CM03 | −21 | −31 | −44 |
| INVENTION | C04 + M05 | −04 | −08 | −19 |
| | C04 + M07 | −02 | −07 | −19 |
| | C04 + M12 | −02 | −05 | −14 |
| | C04 + M20 | −04 | −09 | −23 |
| COMPARISON | C06 + CM01 | −04 | −07 | −17 |
| | C06 + CM02 | 00 | 00 | −18 |
| INVENTION | C06 + M05 | 00 | 00 | −07 |
| | C06 + M06 | −01 | −02 | −07 |
| | C06 + M07 | −02 | −03 | −06 |
| | C06 + M12 | 00 | 00 | −04 |
| | C06 + M20 | −01 | −03 | −07 |
| COMPARISON | C07 + C08 + CM01 | −03 | −05 | −11 |
| | C07 + C08 + CM02 | −02 | −03 | −11 |
| INVENTION | C07 + C08 + M05 | −01 | −02 | −05 |
| | C07 + C08 + M06 | −01 | −02 | −04 |
| | C07 + C08 + M07 | 00 | −03 | −07 |
| | C07 + C08 + M12 | −02 | −02 | −04 |
| | C07 + C08 + M20 | −02 | −04 | −08 |
| COMPARISON | C08 + CM01 | −01 | −03 | −06 |
| | C08 + CM02 | −02 | −03 | −07 |
| INVENTION | C08 + M06 | 00 | −01 | −02 |
| | C08 + M12 | −02 | −02 | −03 |

It is shown in the Tables the N-alkyl-N-aryl-substituted tricyanovinylaniline dyes corresponding to the general formula I, when in mixed state on the receiver sheet with a yellow dye according to formula (II) or a cyan dye to form red and blue image shades, enjoy a substantially reduced catalytic fading effect and a very good light-fastness. Vivid blue and vivid red and orange colours were obtained in the full colour areas on the receiver sheet after thermal diffusion of the dye combinations according to the invention.

We claim:

1. Dye-donor element for use according to thermal dye transfer methods, said element comprising a support having thereon a dye layer comprising a combination of dyes, wherein the constituting dyes of said combination comprise at least one yellow and/or at least one cyan dye as well as at least one magenta dye, said magenta dye corresponds to the general formula (I):

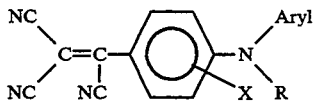

(I)

wherein:

X represents hydrogen or a substituent,

Aryl represents a phenyl group or a substituted phenyl group, and

R represents methyl, substituted methyl, an alkyl group having a branched carbon chain or an unbranched carbon chain, a substituted alkyl group having a branched carbon chain or an unbranched carbon chain group a cycloalkyl group, or a substituted cycloalkyl group, and said yellow dye corresponds to the general formula (II):

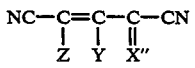

(II)

wherein:

Z represents CN, $COOR^9$, or $CONR^{10}R^{11}$;

$R^9$, $R^{10}$, and $R^{11}$ each independently represent hydrogen substituted or unsubstituted alkyl, substituted or unsubstituted cycloalkyl, substituted or unsubstituted aryl, or $R^{10}$ and $R^{11}$ together with the nitrogen atom to which they are attached represent the atoms needed to complete a heterocyclic nucleus or substituted heterocyclic nucleus;

Y represents $OR^{12}$ or $NR^{13}R^{14}$, or CN;

$R^{12}$ represents hydrogen, substituted or unsubstituted alkyl, substituted or unsubstituted cycloalkyl substituted or unsubstituted aryl, $SO_2R^{15}$, $COR^{15}$, $CSR^{15}$, or $POR^{15}R^{16}$;

$R^{13}$ and $R^{14}$ each independently represents hydrogen, substituted or unsubstituted alkyl, substituted or unsubstituted cycloalkyl, substituted or unsubstituted aryl, substituted or unsubstituted amino, $SO_2R^{15}$, $COR^{15}$, $CSR^{15}$, $POR^{15}R^{16}$, or $R^{13}$ and $R^{14}$ together with the nitrogen atom to which they are attached represent the atoms needed to complete a heterocyclic nucleus or substituted heterocyclic nucleus or a heterocyclic nucleus with an aliphatic or aromatic ring fused-on;

$R^{15}$ and $R^{16}$ each independently represent substituted or unsubstituted alkyl, substituted or unsubstituted cycloalkyl, substituted or unsubstituted alkenyl, substituted or unsubstituted aralkyl, substituted or unsubstituted aryl, substituted or unsubstituted alkyloxy, substituted or unsubstituted aryloxy, substituted or unsubstituted alkylthio, substituted or unsubstituted arylthio, substituted or unsubstituted amino, or a substituted or unsubstituted heterocyclic group, or $R^{15}$ and $R^{16}$ together with the phosphorus atom to which they are attached represent the atoms needed to complete a 5- or 6 -membered ring;

X″ represents $CR^{17}R^{18}$; and $R^{17}$ and $R^{18}$ each independently represent hydrogen, substituted or unsubstituted alkyl, substituted or unsubstituted cycloalkyl, substituted or unsubstituted aryl, substituted or unsubstituted alkenyl, substituted or unsubstituted alkynyl, a substituted or unsubstituted heterocyclic ring, cyano halogen, $SO_2R^{15}$, $COR^{15}$, $CSR^{15}$, $POR^{15}$, $R^{16}$, $R^{17}$, and $R^{18}$ or and together with the carbon atom to which they are attached represent the atoms needed to complete a substituted or unsubstituted ring.

2. A dye-donor element according to claim 1, wherein said cyan dye corresponds to the general formula (II bis):

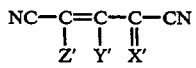

(II bis)

wherein:

Z′ represents CN, $COOR^{19}$, or $CONR^{20}$, or $R^{21}$;

$R^{19}$, $R^{20}$, and $R^{21}$ each independently represent hydrogen substituted or unsubstituted alkyl, substituted or unsubstituted cycloalkyl, substituted or unsubstituted aryl, or $R^{20}$ and $R^{21}$ together with the nitrogen atom to which they are attached represent the atoms needed to complete a heterocyclic nucleus or substituted heterocyclic nucleus;

Y represents $OR^{12}$ or $NR^{13}R^{14}$ or CN;

$R^{22}$ represents hydrogen, substituted or unsubstituted alkyl, substituted or unsubstituted cycloalkyl, substituted or unsubstituted aryl, $SO_2R^{25}$, $COR^{25}$, $CSR^{25}$, or $POR^{25}$, $R^{26}$;

$R^{23}$ and $R^{24}$ each independently represents hydrogen, substituted or unsubstituted alkyl, substituted or unsubstituted cycloalkyl, substituted or unsubstituted aryl, substituted or unsubstituted amino, $SO_2R^{25}$, $COR^{25}$, $CSR^{25}$, or $POR^{25}$, $R^{26}$, or $R^{23}$ and $R^{24}$ together with the nitrogen atom to which they are attached represent the atoms needed to complete a heterocyclic nucleus or substituted heterocyclic nucleus or a heterocyclic nucleus with an aliphatic or aromatic ring fused-on;

$R^{25}$ and $R^{26}$ each independently represent substituted or unsubstituted alkyl , substituted or unsubstituted cycloalkyl, substituted or unsubstituted alkenyl, substituted or unsubstituted aralkyl, substituted or unsubstituted aryl, substituted or unsubstituted alkyloxy, substituted or unsubstituted aryloxy, substituted or unsubstituted alkylthio, substituted or unsubstituted arylthio, substituted or unsubstituted amino, or a substituted or unsubstituted heterocyclic group, or $R^{25}$ and $R^{26}$ together with the phosphorus atom to which they are attached represent the atoms needed to complete a 5-or 6 -membered ring;

X′ represents N-Ar or N-Het; Ar represents an aromatic nucleus substituted in para position by a substituent chosen from the group consisting of substituted or unsubstituted amino, substituted or unsubstituted alkyloxy, substituted or unsubstituted aryloxy, substituted or unsubstituted alkylthio, substituted or unsubstituted arylthio, hydroxy, or mercapto; and Het represents a substituted or unsubstituted heterocyclic ring.

3. A dye-donor element according to claim 1, wherein said cyan dye corresponds to the general formula (III):

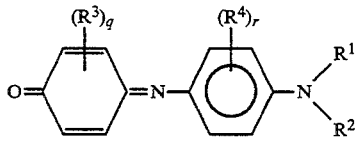

(III)

wherein:

$R^1$ and $R^2$ each independently represent hydrogen, an alkyl group, a cycloalkyl group, an aryl group, an allyl group, or an alkenyl group, or $R^1$ and $R^2$ together with the nitrogen to which they are attached form the necessary atoms to complete a 5-or 6-membered heterocyclic ring, or $R^1$ and/or $R^2$ together with the nitrogen to which they are attached and either or both carbon atoms in ortho-position on the phenyl ring with respect to said nitrogen atom form a 5- or 6-membered heterocyclic ring, which ring may carry at least one substituent;

$R^3$ represents a halogen atom, hydroxy, cyano, an alkyl group, a cycloalkyl group, an aryl group, an alkoxy group, an aryloxy group, an alkylthio group, an arylthio group, an amino group, nitro, an alkylcarbamoyl group, an arylcarbamoyl group, an arylsulfamoyl group, an alkoxycarbamoyl group, an aryloxycarbamoyl group, an alkylthiocarbamoyl group, an arylthiocarbamoyl group, an alkylphosphoramidate group, an arylphosphoramidate group, an alkylphosphonamidate group, an arylphosphonamidate group, an alkylaminocarbonyl group or an arylaminocarbonyl group, which groups may carry at least one substituent, or $R^3$ represents the necessary atoms to close an alicyclic or aromatic or heterocyclic ring fused-on the cyclohexadiene ring;

q represents 0, 1, 2, 3, or 4, the $R^3$ substituents being the same or different when $q>1$;

$R^4$ can have any of the significances given above for $R^3$ or can represent the necessary atoms to complete an alicyclic or aromatic or heterocyclic ring (which ring may carry at least one substituent) fused-on the benzene ring; and r represents 0, 1, 2, 3 or 4, the $R^4$ substituents being the same or different when $r>1$.

4. A dye-donor element according to claim 1, wherein said cyan dye corresponds to the general formula (IV):

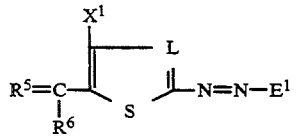

(IV)

wherein:

$R^5$ is the residue of an active methylene compound, $R^6$ is hydrogen or cyano, $X^1$ is hydrogen or a substituent, L is =N— or

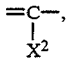

$X^2$ is hydrogen or a substituent, $E^1$ is the residue of a coupler compound,

5. A dye-donor element according to claim 1, wherein said cyan dye corresponds to the general formula (V):

(V)

wherein:

A is the residue of a diazotizable aniline or substituted diazotizable aniline,

B is an optionally substituted thiophen-2,5-ylene or thiazol-2,5-ylene linking group, $E^2$ is the residue of an aromatic coupler compound.

6. Receiver sheet carrying in a dye-image-receiving layer a heat-transferred dye combination, wherein the constituting dyes of said combination comprise at least one yellow and/or at least one cyan dye as well as at least one magenta dye, said magenta dye corresponds to the general formula (I):

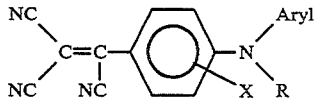

(I)

wherein:

X represents hydrogen or a substituent,

Aryl represents a phenyl group or a substituted phenyl group, and

R represents methyl, substituted methyl, an alkyl group having a branched carbon chain or an unbranched carbon chain, a substituted alkyl group having a branched carbon chain or an unbranched carbon chain group, a cycloalkyl group, or a substituted cycloalkyl group, and said yellow dye corresponds to the general formula (II):

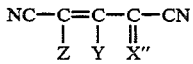

(II)

wherein:

Z represents CN, $COOR^9$, or $CONR^{10}R^{11}$;

$R^9$, $R^{10}$, and $R^{11}$ each independently represent hydrogen, substituted or unsubstituted alkyl, substituted or unsubstituted cycloalkyl, substituted or unsubstituted aryl, or $R^{10}$ and $R^{11}$ together with the nitrogen atom to which they are attached represent the atoms needed to complete a heterocyclic nucleus or substituted heterocyclic nucleus;

Y represents $OR^{12}$ or $NR^{13}R^{14}$, or CN;

$R^{12}$ represents hydrogen, substituted or unsubstituted alkyl, substituted or unsubstituted cycloalkyl, substituted or unsubstituted aryl, $SO_2R^{15}$, $COR^{15}$, $CSR^{15}$, or $POR^{15}R^{16}$;

$R^{13}$ and $R^{14}$ each independently represents hydrogen, substituted or unsubstituted alkyl, substituted or unsubstituted cycloalkyl, substituted or unsubstituted aryl, substituted or unsubstituted amino, $SO_2R^{15}$, $COR^{15}$, $CSR^{15}$, $POR^{15}R^{16}$, or $R^{13}$ and $R^{14}$ together with the nitrogen atom to which they are attached represent the atoms needed to complete a heterocyclic nucleus or substituted heterocyclic nucleus or a heterocyclic nucleus with an aliphatic or aromatic ring fused-on;

$R^{15}$ and $R^{16}$ each independently represent substituted or unsubstituted alkyl, substituted or unsubstituted cycloalkyl, substituted or unsubstituted alkenyl, substituted or unsubstituted aralkyl, substituted or unsubstituted aryl , substituted or unsubstituted alkyloxy, substituted or unsubstituted aryloxy, substituted or unsubstituted alkylthio, substituted or unsubstituted arylthio, substituted or unsubstituted amino, or a substituted or unsubstituted heterocyclic group, or $R^{15}$ and $R^{16}$ together with the phosphorus atom to which they are attached represent the atoms needed to complete a 5-or 6-membered ring;

X" represents $CR17R^{18}$; and $R^{17}$ and $R^{18}$ each independently represent hydrogen, substituted or unsubstituted alkyl, substituted or unsubstituted cycloalkyl, substituted or unsubstituted aryl, substituted or unsubstituted alkenyl, substituted or unsubstituted alkynyl, a substituted or unsubstituted heterocyclic ring, cyano halogen, $SO_2R^{15}$, $COR^{15}$, $CSR^{15}$, $POR^{15}R^{16}$, $R^{17}$ and $R^{18}$ together with the carbon atom to which they are attached represent the atoms needed to complete a substituted or unsubstituted ring.

7. A receiver sheet according to claim 6, wherein said dye-image-receiving layer comprises polyvinyl chloride.

8. Method of forming an image, by thermal transfer of a combination of dyes from a dye-donor element to a receiver sheet, wherein the constituting dyes of said combination comprise at least one yellow and/or at least one cyan dye as well as at least one magenta dye, said magenta dye corresponds to the general formula (I):

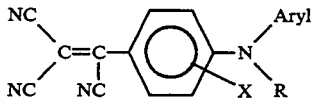

(I)

wherein:

represents hydrogen or a substituent,

Aryl represents a phenyl group or a substituted phenyl group, and

R represents methyl, substituted methyl, an alkyl group having a branched carbon chain or an unbranched carbon chain, a substituted alkyl group having a branched carbon chain or an unbranched carbon chain group, a cycloalkyl group, or a substituted cycloalkyl group, and said yellow dye corresponds to the general formula (II):

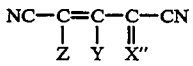

(II)

wherein:

Z represents CN, $COOR^9$, or $CONR^{10}R^{11}$;

$R^9$, $R^{10}$, and $R^{11}$ each independently represent hydrogen substituted or unsubstituted alkyl, substituted or unsubstituted cycloalkyl, substituted or unsubstituted aryl, or $R^{10}$ and $R^{11}$ together with the nitrogen atom to which they are attached represent the atoms needed to complete a heterocyclic nucleus or substituted heterocyclic nucleus;

Y represents $OR^{12}$ or $NR^{13}R^{14}$, or CN;

$R^{12}$ represents hydrogen, substituted or unsubstituted alkyl, substituted or unsubstituted cycloalkyl, substituted or unsubstituted aryl, $SO_2R^{15}$, $COR^{15}$, $CSR^{15}$, or $POR^{15}R^{16}$;

$R^{13}$ and $R^{14}$ each independently represents hydrogen, substituted or unsubstituted alkyl, substituted or unsubstituted cycloalkyl, substituted or unsubstituted aryl, substituted or unsubstituted amino, $SO_2R^{15}$, $COR^{15}$, $CSR^{15}$, $POR^{15}R^{16}$, or $R^{13}$ and $R^{14}$ together with the nitrogen atom to which they are attached represent the atoms needed to complete a heterocyclic nucleus or substituted heterocyclic nucleus or a heterocyclic nucleus with an aliphatic or aromatic ring fused-on;

$R^{15}$ and $R^{16}$ each independently represent substituted or unsubstituted alkyl, substituted or unsubstituted cycloalkyl, substituted or unsubstituted alkenyl, substituted or unsubstituted aralkyl, substituted or unsubstituted aryl, substituted or unsubstituted alkyloxy, substituted or unsubstituted aryloxy, substituted or unsubstituted alkylthio, substituted or unsubstituted arylthio, substituted or unsubstituted amino, or a substituted or unsubstituted heterocyclic group, or $R^{15}$ and $R^{16}$ together with the phosphorus atom to which they are attached represent the atoms needed to complete a 5-or 6 -membered ring;

X" represents $CR^{17}R^{18}$; and $R^{17}$ and $R^{18}$ each independently represent hydrogen, substituted or unsubstituted alkyl, substituted or unsubstituted cycloalkyl, substituted or unsubstituted aryl, substituted or unsubstituted alkenyl, substituted or unsubstituted alkynyl, a substituted or unsubstituted heterocyclic ring, cyano halogen $SO_2R^{15}$, $COR^{15}$, $CSR^{15}$, $POR^{15}R^{16}$, or $R^{17}$ and $R^{18}$ together with the carbon atom to which they are attached represent the atoms needed to complete a substituted or unsubstituted ring.

9. A method according to claim 8, wherein said receiver sheet carries a dye-image-receiving layer comprising polyvinyl chloride.

* * * * *

UNITED STATES PATENT AND TRADEMARK OFFICE

CERTIFICATE OF CORRECTION

PATENT NO. : 5,420,097

DATED : May 30, 1995

INVENTOR(S) : Luc Vanmaele et al

It is certified that error appears in the above-indentified patent and that said Letters Patent is hereby corrected as shown below:

[57] Abstract, last line, "full color area" should read -- full colour areas --;

Column 4, line 31, "$POR^{25},R^{26}$" should read -- $POR^{25}R^{26}$ --;

Column 4, line 35, "substituted Or unsubstituted" should read -- substituted or unsubstituted --;

Column 4, line 36, "$POR^{25},R^{26}$" should read -- $POR^{25}R^{26}$ --;

Column 4, line 52, "or --N-Het" should read -- or N-Het --;

Column 5, line 37, "an alkylcarbamoyl group" should read -- an alkoxycarbamoyl group --;

Column 7, TABLE 1, Dye No. M07 (column R), "$CH_2OCH_2CH_2$-" should read -- $CH_3OCH_2CH_2$- --;

Column 12, line 18, "Suitable, slipping layers" should read -- Suitable slipping layers --;

Column 12, line 63, "and/or Of" should read -- and/or of --;

Column 14, line 56, "status A mode." should read -- Status A mode. --;

Column 14, line 67, "is given These" should read -- is given. These --;

UNITED STATES PATENT AND TRADEMARK OFFICE

CERTIFICATE OF CORRECTION

PATENT NO. : 5,420,097

DATED : May 30, 1995

INVENTOR(S) : Luc Vanmaele et al

It is certified that error appears in the above-indentified patent and that said Letters Patent is hereby corrected as shown below:

Column 14, line 68, "o the following formula (V):" should read -- to the following formula (VI): --;

Claim 1, column 20, line 7, "cyano halogen," should read -- cyano, halogen, --;

Claim 1, column 20, lines 8 and 9, "$POR^{15}$,$R^{16}$,$R^{17}$, and $R^{18}$ or and together with" should read -- $POR^{15}R^{16}$, or $R^{17}$ and $R^{18}$ together with --;

Claim 2, column 20, line 22, "$CONR^{20}$, or $R^{21}$;" should read -- $CONR^{20}R^{21}$; --;

Claim 2, column 20, line 34, "or $POR^{25}$,$R^{26}$;" should read -- or $POR^{25}R^{26}$; --;

Claim 2, column 20, line 39, "or $POR^{25}$,$R^{26}$, or $R^{23}$" should read -- or $POR^{25}R^{26}$, or $R^{23}$ --;

Claim 6, column 23, line 27, "cyano halogen," should read -- cyano, halogen, --;

Claim 6, column 23, line 28, "$POR^{15}R^{16}$, $R^{17}$ and $R^{18}$" should read -- $POR^{15}R^{16}$, or $R^{17}$ and $R^{18}$ --;

Claim 8, column 23, line 50, "represents hydrogen or a substituent," should read -- X represents hydrogen or a substituent, --;

UNITED STATES PATENT AND TRADEMARK OFFICE

CERTIFICATE OF CORRECTION

PATENT NO. : 5,420,097

DATED : May 30, 1995

INVENTOR(S) : Luc Vanmaele et al

It is certified that error appears in the above-indentified patent and that said Letters Patent is hereby corrected as shown below:

Claim 8, column 24, line 51, "cyano halogen," should read -- cyano, halogen, --.

Signed and Sealed this

Twenty-third Day of July, 1996

*Attest:*

Bruce Lehman

BRUCE LEHMAN

*Attesting Officer*

*Commissioner of Patents and Trademarks*